US006553690B2

(12) United States Patent
Di Girolamo

(10) Patent No.: US 6,553,690 B2
(45) Date of Patent: Apr. 29, 2003

(54) VENTILATED FOOTWEAR

(75) Inventor: Mario Di Girolamo, Chomeday Laval (CA)

(73) Assignee: Opal Limited, Nassau (BS)

( * ) Notice: Subject to any disclaimer, the term of this patent is extended or adjusted under 35 U.S.C. 154(b) by 0 days.

(21) Appl. No.: 10/016,425

(22) Filed: Dec. 10, 2001

(65) Prior Publication Data

US 2002/0095819 A1 Jul. 25, 2002

Related U.S. Application Data

(63) Continuation of application No. 09/430,791, filed on Oct. 29, 1999, now abandoned.

(51) Int. Cl.[7] ..... A43B 7/08
(52) U.S. Cl. ..... 36/3 R; 36/3 B
(58) Field of Search ..... 36/3 B, 3 R, 3 A

(56) References Cited

U.S. PATENT DOCUMENTS

| | | | | |
|---|---|---|---|---|
| 80,518 | A | | 7/1868 | Thomas |
| 425,254 | A | | 4/1890 | Rau |
| 452,655 | A | | 5/1891 | Valiant |
| 760,401 | A | * | 5/1904 | Sandmeyer |
| 895,950 | A | | 8/1908 | Von Bracht |
| 997,658 | A | | 7/1911 | Duncan |
| 1,086,925 | A | | 2/1914 | Löffler |
| 1,103,874 | A | | 7/1914 | Halley |
| 1,128,391 | A | | 2/1915 | Valiant |
| 1,317,161 | A | | 9/1919 | Hay |
| 1,962,822 | A | | 6/1934 | Krakau |
| RE19,494 | E | | 3/1935 | Glidden et al. |
| 2,027,757 | A | | 1/1936 | Whitfield et al. |
| 2,190,802 | A | * | 2/1940 | Powell |
| 2,266,476 | A | | 12/1941 | Riess |
| 2,318,148 | A | | 5/1943 | Ettelbrick, Sr. et al. |
| 2,344,762 | A | | 3/1944 | Wylie |
| 2,408,792 | A | | 10/1946 | Morgolin |

(List continued on next page.)

FOREIGN PATENT DOCUMENTS

| | | | |
|---|---|---|---|
| BE | 534562 | | 1/1955 |
| EP | 0 100 067 | A2 | 7/1983 |
| EP | 350103 | * | 1/1990 |
| EP | 0 350 103 | A2 | 1/1990 |
| EP | 0 437 869 | A2 | 7/1991 |
| FR | 854.586 | | 1/1939 |
| FR | 1.024.960 | | 1/1953 |
| FR | 1.310.482 | | 1/1961 |
| FR | 2 109 206 | | 10/1970 |
| FR | 2116790 | | 7/1972 |
| FR | 2 515 938 | | 11/1981 |
| FR | 2 614 510 | | 4/1987 |
| WO | 95/13716 | | 5/1995 |
| WO | 98/14081 | | 4/1998 |

*Primary Examiner*—Ted Kavanaugh
(74) *Attorney, Agent, or Firm*—Dykema Gossett PLLC

(57) ABSTRACT

The ventilated footwear comprises a lower part incorporating a sole, an upper part coupled to the lower part and shaped to receive a foot of a wearer. The upper part has an arch portion and is provided with an inside surface adapted to permit air circulation therethrough, and an outside surface provided with ventilation holes located in the arch portion of the upper part of the footwear. A waterproof and breathable membrane is sandwiched between the inside and outside surfaces in the arch portion of the upper part of the footwear across the holes. Furthermore, an insole is preferably disposed into the footwear. The insole has an arch portion adjacently located to the arch portion of the upper part of the footwear. The upper layer of the insole is adapted to permit air circulation therethrough. The insole has a bottom layer provided with transverse intersecting channels extending inwardly from a peripheral edge of the insole. At least one of the channels is adjacent to the holes located in the arch portion of the outside surface of the upper part of the footwear. The channels are provided with openings in communication with the upper layer.

11 Claims, 5 Drawing Sheets

U.S. PATENT DOCUMENTS 2,435,131 A 1/1948 Desbiens
2,441,879 A 5/1948 Gantt
2,545,062 A 3/1951 Whittington
2,558,973 A 7/1951 Meaker
2,720,041 A 10/1955 Kajtar
2,741,038 A 4/1956 Eliassen
2,751,692 A 6/1956 Cortina
2,851,390 A 9/1958 Chavannes
2,887,793 A 5/1959 Starr
3,012,342 A 12/1961 Ramirez
3,027,659 A 4/1962 Gianola
3,044,188 A 7/1962 Evangelista
3,050,875 A 8/1962 Robbins
3,225,463 A 12/1965 Burnham
3,256,621 A 6/1966 Linton
3,273,264 A 9/1966 Farinello, Jr.
3,310,887 A 3/1967 Stokis
3,331,146 A 7/1967 Karras
3,383,782 A 5/1968 McGinnity
3,426,455 A 2/1969 Drago
3,475,836 A 11/1969 Brahm
3,624,930 A 12/1971 Johnson et al.
3,648,390 A 3/1972 Corvi
3,716,930 A 2/1973 Brahm
3,754,339 A 8/1973 Terasaki
3,973,336 A 8/1976 Ahn
4,000,566 A 1/1977 Famolare, Jr.
4,063,371 A 12/1977 Batra
4,071,963 A 2/1978 Fukuoka
4,078,321 A 3/1978 Famolare, Jr.
4,100,685 A 7/1978 Dassler
4,112,599 A 9/1978 Krippelz
4,137,653 A 2/1979 Famolare, Jr.
4,215,492 A 8/1980 Sandmeier
4,224,746 A 9/1980 Kim
4,233,758 A 11/1980 Aubery
4,343,097 A 8/1982 Sasaki
4,364,186 A 12/1982 Fukuoka
4,373,274 A 2/1983 Michalski
4,408,401 A 10/1983 Seidel et al.
4,420,893 A 12/1983 Stephen
4,438,573 A 3/1984 McBarron
4,445,284 A 5/1984 Sakutori
4,476,600 A 10/1984 Seidel et al.
4,499,672 A 2/1985 Kim
4,507,880 A 4/1985 Ohashi
4,602,441 A 7/1986 El Sakkaf
4,617,745 A 10/1986 Batra
D287,302 S 12/1986 Peterson
4,633,597 A 1/1987 Shiang
4,654,982 A 4/1987 Lee
D290,423 S 6/1987 Peterson
4,742,625 A 5/1988 Sydor et al.
4,760,651 A 8/1988 Pon-Tzu
4,771,555 A 9/1988 Ohashi
4,776,110 A * 10/1988 Shiang
4,813,160 A 3/1989 Kuznetz
4,823,799 A 4/1989 Robbins
4,831,749 A 5/1989 Tsai
4,835,883 A 6/1989 Tetrault et al.
4,837,948 A 6/1989 Cho
4,860,463 A 8/1989 Pin
4,885,849 A 12/1989 Lambert
4,888,887 A 12/1989 Solow
4,894,932 A 1/1990 Harada et al.
4,912,858 A 4/1990 Mochizuki
5,010,661 A 4/1991 Chu
5,035,068 A 7/1991 Biasi
5,044,096 A * 9/1991 Polegato
5,068,981 A 12/1991 Jung
5,086,572 A * 2/1992 Lee
5,220,791 A 6/1993 Bulzomi
5,224,277 A 7/1993 Sang Do
5,282,324 A 2/1994 Cheng
5,295,312 A 3/1994 Blumberg et al.
5,295,313 A 3/1994 Lee
5,299,368 A 4/1994 Liu
5,341,581 A 8/1994 Huang
5,357,689 A 10/1994 Awai
5,369,895 A 12/1994 Hammerschmidt
5,400,526 A 3/1995 Sessa
5,465,508 A 11/1995 Bourdeau
5,505,010 A 4/1996 Fukuoka
5,505,011 A 4/1996 Bleimhofer
5,572,804 A 11/1996 Skaja et al.
5,588,226 A * 12/1996 Schenkel
5,598,644 A 2/1997 Polegato
5,606,806 A 3/1997 O'Dwyer
5,697,170 A 12/1997 Murrell et al.
5,746,012 A 5/1998 Caletti et al.
5,813,140 A 9/1998 Obeid
5,826,349 A 10/1998 Goss
5,845,417 A 12/1998 Reed et al.
5,860,225 A 1/1999 O'Dwyer
5,983,524 A * 11/1999 Polegato
6,041,519 A * 3/2000 Cheng

* cited by examiner 28
32
VI
VII
V
40
30
36

VENTILATED FOOTWEAR

This application is a continuation of U.S. application Ser. No. 09/430,791 filed on Oct. 29, 1999 now abandoned.

FIELD OF THE INVENTION

The present invention relates to ventilated footwear. More specifically, the present invention relates to footwear having openings in the arch area of the upper, a waterproof and breathable membrane across said openings, and a compressible insole with openings in the top side in communication with channels on the underside which are in communication with the openings in the arch area of the upper for ventilating the interior of a footwear.

BACKGROUND OF THE INVENTION

Many kinds of footwear, such as athletic shoes, everyday walking shoes, and work boots have the drawback of poor ventilation. The inherent confining of the foot does not allow it to breathe, causing the foot to perspire and thereby promoting the development of bacteria, fungi and the like as well as the accompanying unpleasant odors and skin problems.

There have been various attempts to solve the problem of ventilating a shoe. A plethora of footwear constructions having various ventilation arrangements are known in the art. Openings in the upper are well known but suffer from the obvious problem of admitting debris and water. Complicated valve arrangements have been suggested by the prior art to close the opening. Many of the approaches have included a pumping means encased within the sole of the shoe, sometimes in communication with the openings in the upper. Generally, the weight of the foot is used to compress a bladder and force air out of apertures to ventilate the foot. Problems have also existed with failure of the bladder to reinflate. The shape and position of the bladder, or air pump, has been such that enough weight is always on it to prevent full inflation. Such mechanisms are typically prohibitively expensive to build into footwear and such complicated multi-component mechanisms are prone to failure and given that most of these prior art devices are built into the shoe, they are not easily repairable or replaceable.

There are also a variety of other solutions disclosed in order to improve ventilation, such as that disclosed in U.S. Pat. No. 5,044,096. In this patent, the outsole is coupled to an insole, in which holes are traversing the thickness of the combined insole/outsole structure. The sole structure has a microporous, waterproof membrane disposed between the insole and the outsole, in order to allow the transpiration of the foot while keeping the foot dry. A primary disadvantage of that systems is that the openings to the exterior of the footwear are generally disposed a substantial part of the time against a surface, and such surface itself may be a source of hot air, for example hot road pavement. Another disadvantage with this solution is that since the holes for breathing are on the bottom of the outsole, the holes are often blocked by mud, dust or the like debris, resulting in the inefficient operation of the ventilation system.

SUMMARY OF THE INVENTION

An article of footwear comprising:

a lower part incorporating a sole, an upper part coupled to said lower part and shaped to receive a foot of a wearer, said upper part having an arch portion with a plurality of openings providing communication between the outside of the upper part and the interior of the upper part, a waterproof, breathable membrane across the openings, and a compressible insole with openings in the top side in communication with channels on the underside which are in communication with the openings in the arch area of the upper part, for ventilating the interior of a footwear.

BRIEF DESCRIPTION OF THE DRAWINGS

The present invention and its advantages will be more easily understood after reading the following non-restrictive description of preferred embodiments thereof, made with reference to the following drawings wherein.

DESCRIPTION OF THE PREFERRED EMBODIMENTS

Figure 1:
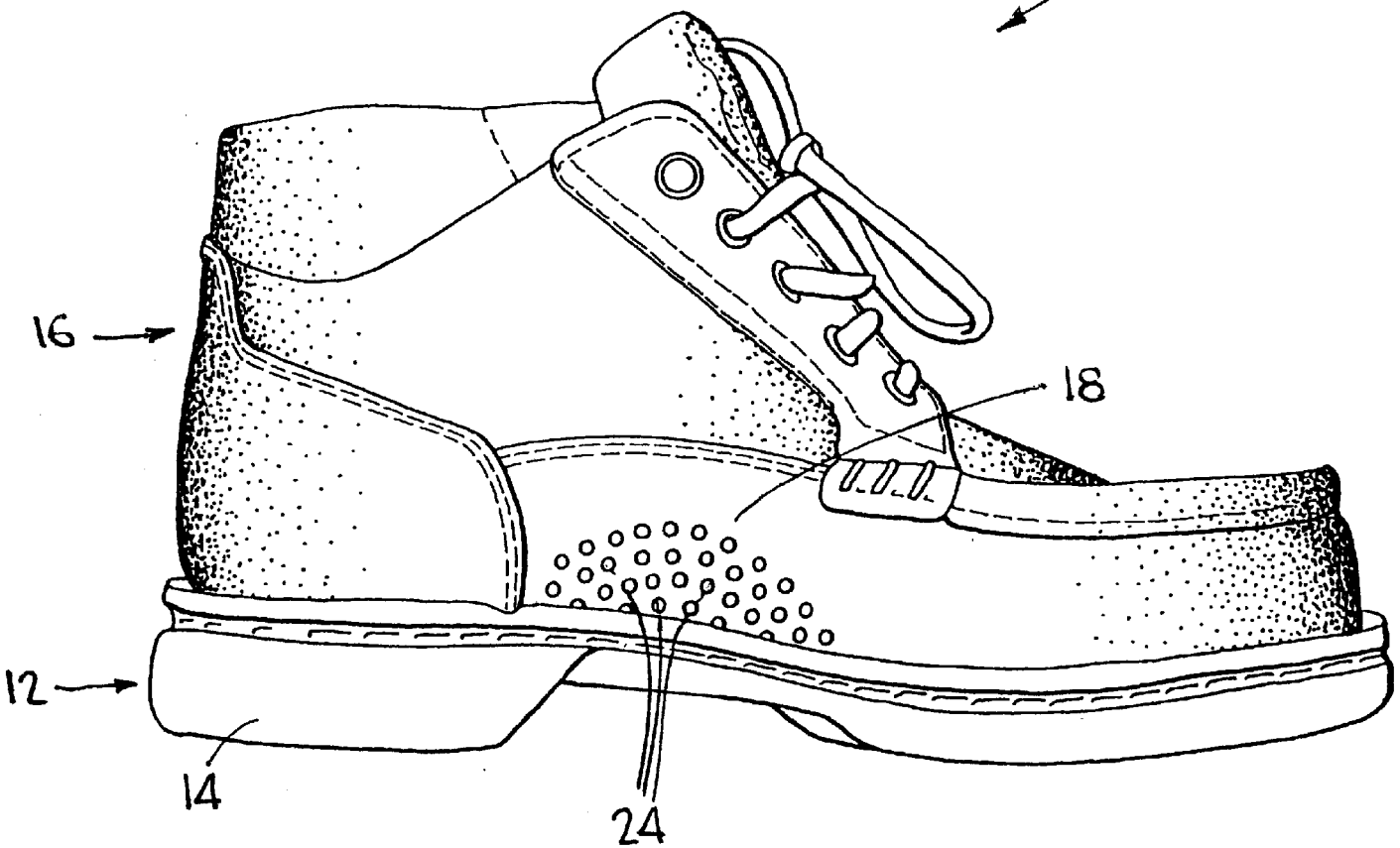
FIG. 1 is a perspective view of a preferred embodiment of the ventilated footwear according to the present invention.

With reference to FIGS. 1 to 4, ventilated footwear (10) according to the present invention comprises a lower part (12) incorporating a sole (14), an upper part (16) coupled to the lower part (12) and shaped to receive a foot of a wearer. The upper part (16) may be of any type of footwear (an athletic shoe, a work boot, a hiking boot, etc.) and may be of any type of material (canvas, leather, synthetic leather, vinyl, plastic, etc.). These materials have a Wide range of breathability, but often the construction of the upper part (16), particularly because of the use of adhesives, substantially reduce the breathability of the upper part (16).

The upper part (16) may also have a lining (20) to provide a comfortable interior surface to be in contact with the foot and/or sock of the wearer. Such linings are typically woven or non-woven textiles, and may have wicking properties. The upper part (16) may be treated with oils, silicone or the like to provide water resistant or water proof properties. Of course, such treatments usually interfere with the breathability of the material comprising the upper part. Waterproof and breathable membranes such as that sold under the GORE-TEX trademark are often also used on the inside of the upper part of footwear to provide water resistance with the intention of minimizing the interference with the breathability of the material comprising the upper part (16).

The upper part (16) has an arch portion (18) located on the medial side of the footwear. A plurality of openings (24) are located in the arch portion (18) of the upper part (16) of the footwear on the outside (22) thereof. The greater the number of openings (24) and the larger the openings (24) the greater degree of ventilation may be provided. The openings (24) may be arranged in almost any configuration to satisfy the aesthetic requirements of the design of the footwear. Typically, the openings (24) will be in the order of a few mm in diameter.

A waterproof, breathable membrane (26) larger than the area of the openings (24) is secured to the upper part (16) across the openings. The membrane (26) is preferably made of material such as the material known by the trademark GORETEX or another equivalent material. Such material allows air and water vapor to move across it, but does not allow water in liquid form to move across it. In the preferred embodiment of the invention, membrane (26) is secured to the interior (20) of the upper part (16) and may be secured between the upper part and any interior lining, although is contemplated that it may be secured to the exterior of the upper part (16). The membrane (26) may be secured by adhesive about the periphery or adhesive tape or stitched, although stitching may require the stitch holes to be sealed to ensure that the stitch holes do not admit water to the interior of the footwear.

The membrane may also be combined with a lining material which may be particularly advantageous when the membrane is to be disposed on the interior of the upper part with no liner between it and the foot (or sock over the foot) of the wearer.

Figure 2:
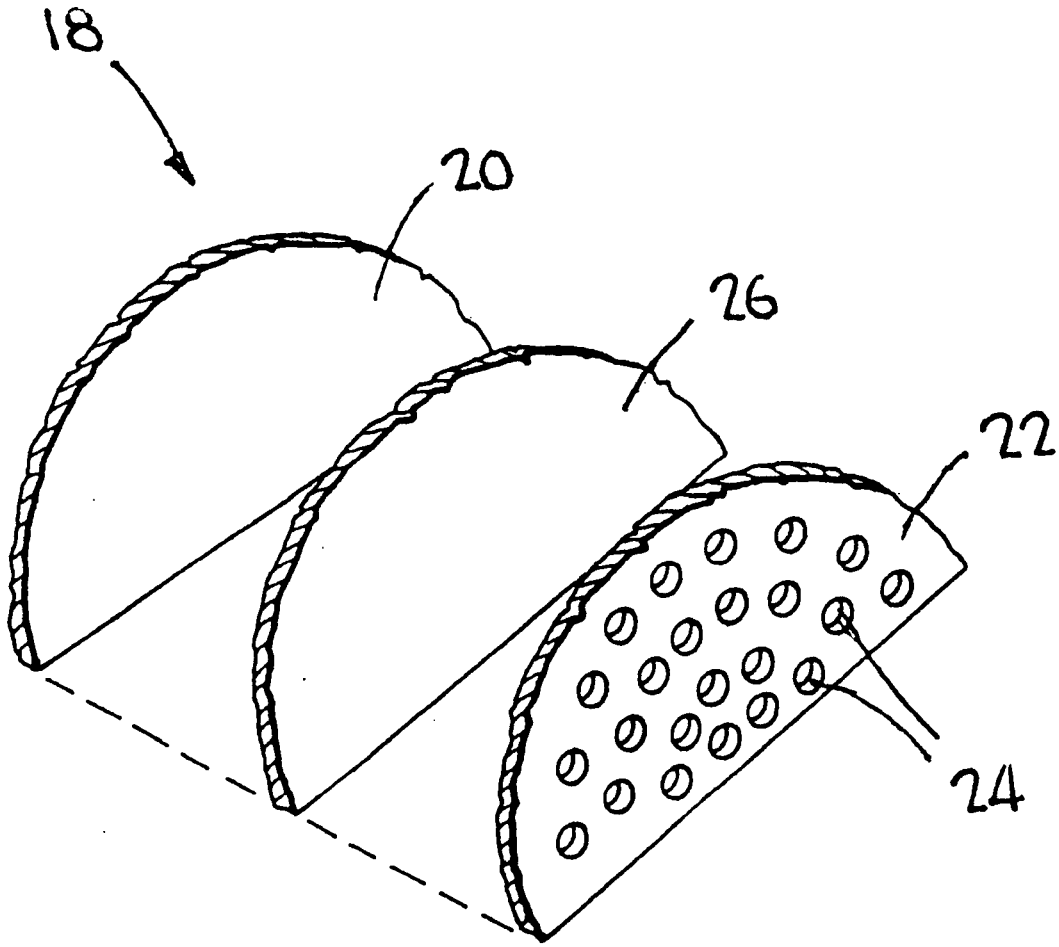
FIG. 2 is an exploded view of the arch portion of the footwear.
Figure 3:
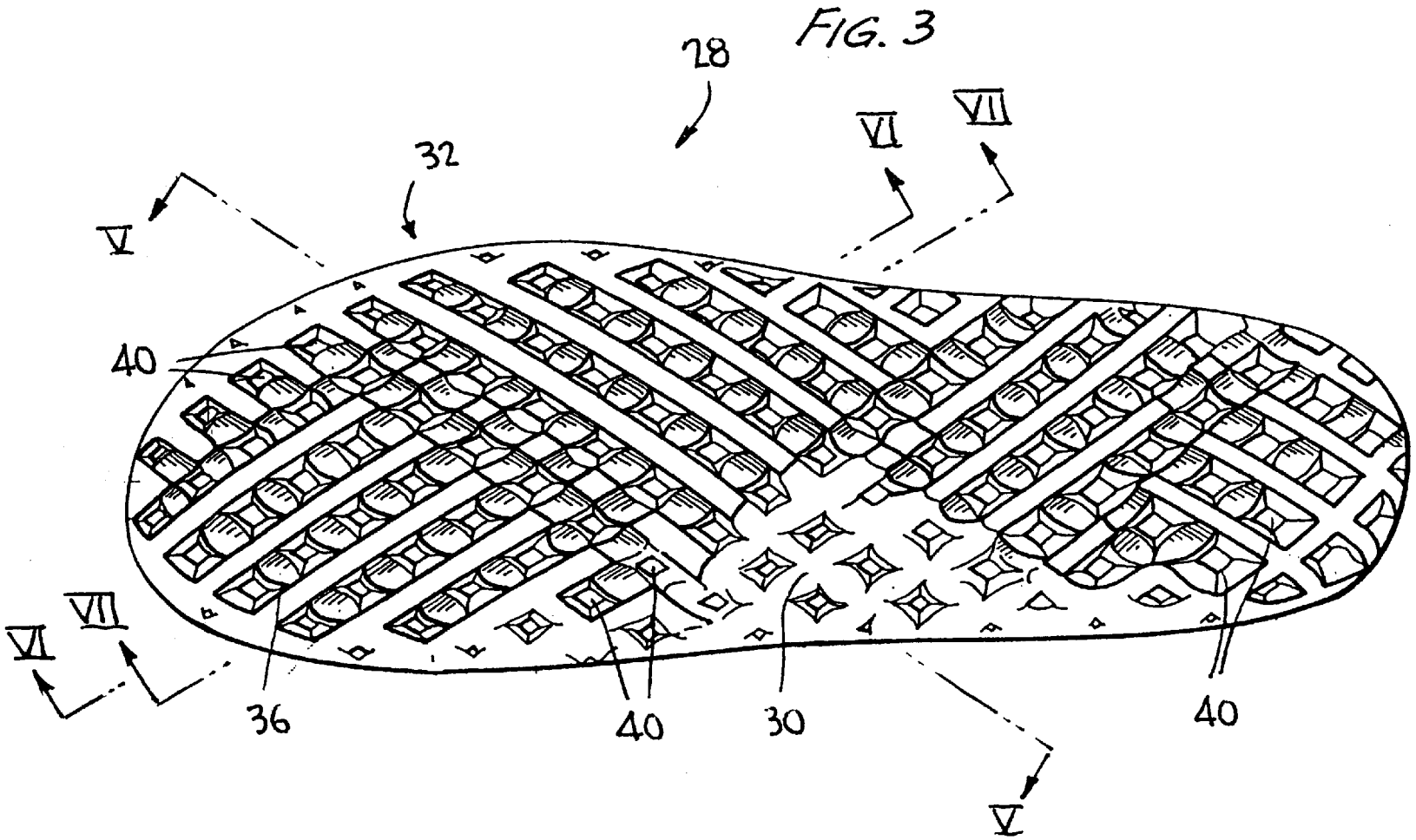
FIG. 3 is an under view of the insole.

Given the usual location and general configuration of the structure of the present invention, the membrane of the preferred embodiment is generally a half circle in shape as shown in FIG. 2.

An insole (28) is preferably disposed into the footwear and it is preferably made of a resilient and compressible material, such as polyurethane, although EVA and other such materials may be used. The insole (28) is shaped to fit within the upper part and is contoured to provide a comfortable footbed for the foot of the wearer. Insoles of this type are well known, an example of one such footbed can be found in U.S. Pat. No. Des. 290,423. The contouring of the insole includes an arch portion (30) which extends upwardly (see FIG. 4) to provide support and comfort for the medial arch of the foot of the wearer.

In the preferred embodiment of the invention, a plurality of openings (40) are provided substantially vertically through the thickness of the insole (28). As with the openings (24) in the upper part, the greater the number of openings (40) and the larger the openings (40) the greater degree of ventilation may be provided by the invention. The size and shape of the openings (40) are limited only to the extent that the support and comfort function of the insole (28) would be compromised. The openings (40) may be arranged in a variety of configurations, again with consideration of the support and comfort function of the insole in mind, and with consideration of the structure of the bottom side of the insole as discussed below.

In the preferred embodiment of the invention, a lining material (32) preferably made of a quilted textile such as the one known by the trademark CAMBRELLE is secured to the top surface in order to provide a comfortable surface for the foot of the wearer as well as air circulation and wicking properties. An alternative lining material such as kidskin leather may also be employed. In the case where a lining material such as the CAMBRELLE textile is employed, the openings (40) may not have to extend through the lining material; however, in the case where kidskin leather is employed, it is desirable that the openings (40) pass through the lining material in order to maximize breathability.

The bottom of the insole is provided with a plurality of substantially horizontal grooves or channels (36) in register with the substantially vertical openings (40) through the thickness of the insole (28) such that the channels (36) are in communication with the openings (40). The channels may be arranged in a variety of configurations with consideration of the location of the substantially vertical openings (40) through the thickness of the insole (28) as well as the support and comfort function of the insole (28) in mind.

The durometer of the insole (28) material, the thickness of the insole (28), and the depth of the channels (36) should be selected such that when a person walks or runs, the insole (28) should substantially compress to provide a pumping action but allow the channels (36) to remain open in order to permit adequate air circulation. The weight of the wearer must, of course be taken into account in making such selections. Such selections are within the abilities of one of ordinary skill in the art and the ranges are not particularly different than that generally presently employed.

Figure 4:
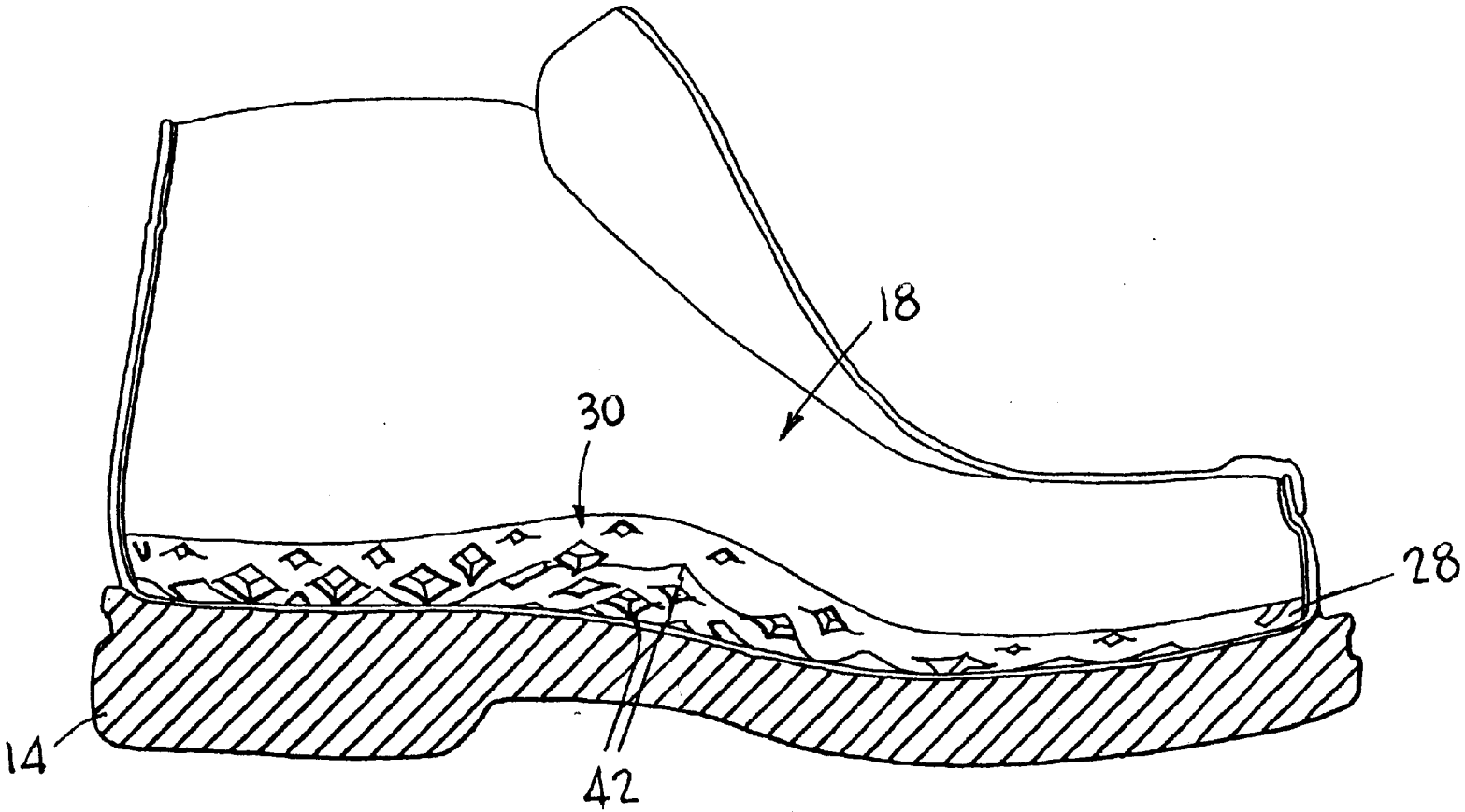
FIG. 4 is a cross-sectional view of a insole operatively inserted within a footwear.
Figure 5:
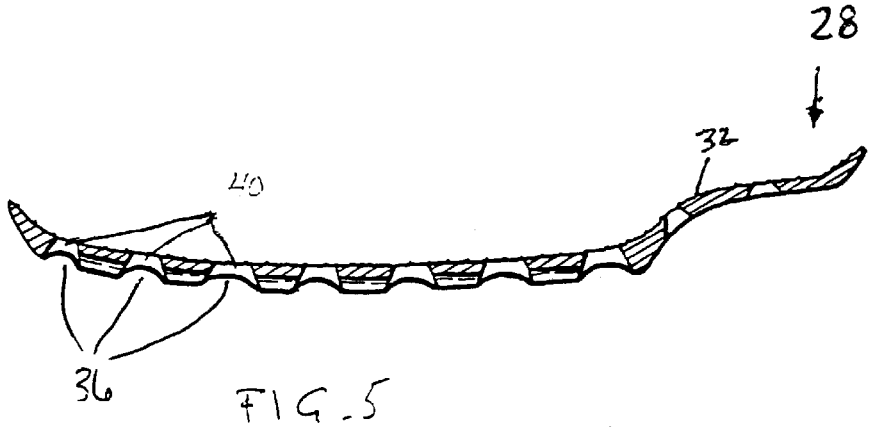
FIG. 5 is a cross-longitudinal view of a channel communicating with the arch portion of the insole of FIG. 3 taken along the line V—V.
Figure 6:
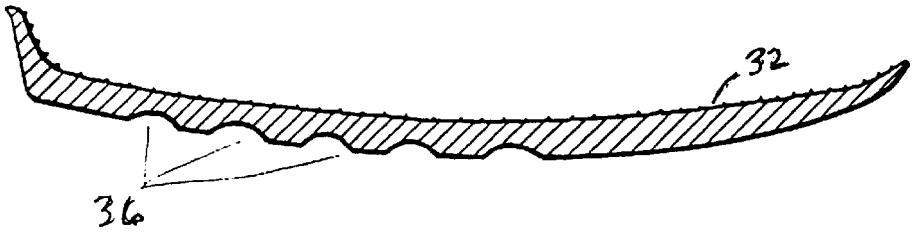
FIG. 6 is a cross-view of the insole of FIG. 3 taken along the line VI—VI.
Figure 7:
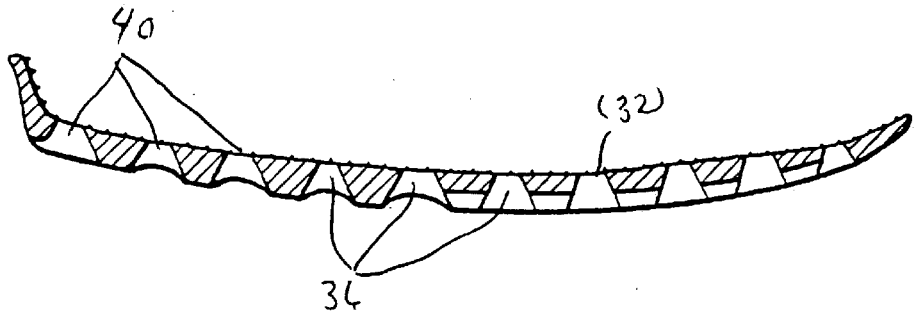
FIG. 7 is a cross-view of the insole of FIG. 3 taken along the line VII—VII.

The plurality of channels (36) are arranged to be in communication with a plurality of channels (42) which extend to the upwardly extending arch portion (30) of the insole (see FIG. 4). These channels (42) are located so as to be in register with the openings (24) in the upper part. In an alternative embodiment of the invention, the channels (42) extending to the upwardly extending arch portion (30) of the insole may terminate in a cavity located in the upwardly extending arch portion (30) underside of the insole (28) and that cavity would be in communication the plurality of the openings (24) in the upper part.

As is apparent from a study of the structure shown and described, upon even the minimal almost imperceptible rocking a person experiences when standing still and even more so in the course of walking, the insole (28) compresses resulting in air being pumped through the channels (36) (42) and through the openings (24) in the upper part. As the wearer's foot is lifted off the ground, and the insole (28) expands to its uncompressed state, low pressure is created within the interior of the upper part and air is thereby drawn into the upper part through the openings (24) therein, through the channels (36) (42). Because of the properties of the membrane (26) across the openings, air carrying water vapor may pass out of the interior of the footwear and fresh air but not water in liquid state or debris may pass into the shoe. The openings (40) through the thickness of the insole permit the circulation of air to extend to that portion of the interior of the footwear above the insole and closer to the foot of the wearer.

The present invention may be provided to a footwear manufacturer or even a shoe repair facility as a kit comprising a template for the openings (24) in the upper part (16), an insole (28) constructed according to the invention and a membrane (26) with adhesive means. Alternatively, the insole can be sold separately for insertion in any kind of shoe that is provided with holes but not necessarily provided with a membrane. Of course, such a combination would provide ventilation but not waterproof capabilities, unless the shoe is provided with a waterproof membrane across the holes. As mentioned herein, the present invention may be employed in wide variety of footwear types employing a wide variety of materials. The overall cost of adding the present invention to footwear is low compared to other ventilation schemes.

It should be understood that the present invention relates to a ventilated footwear (10) such as, regular shoes, athletic shoes, outdoor shoes, casual shoes, ski boots and fishing boots, where there is a need to ventilate the foot of a wearer, and is meant to include, but is not limited to: all categories of children's, women's and men's footwear; basketball, football, soccer, tennis, golf, bicycle shoes; skates (ice or inline); cowboy boots; work boots and shoes; military boots and shoes; nurse's, doctor's and other medical personnel's shoes.

It should also be understood that the holes on the upper part of the shoe could be placed anywhere else on the shoe with appropriate conduits between the holes and the channels of the insole, and such a modification falls within the skill of a person versed in this field. Furthermore, it is apparent that the waterproof membrane can be located on the outside of the shoe or on the inside of the shoe, as long as the membrane is properly protected from accidental rupture, which would remove the waterproof properties of the membrane.

Although the present invention has been explained herein above by way of a preferred embodiment thereof, it should be pointed out that any modification to this preferred embodiment within the scope of the present description is not deemed to alter or change the nature and scope of the present invention, as defined in the appended claims.

What is claimed is:

1. An article of footwear comprises:

an upper part having a plurality of openings directly formed in the upper part in an arch portion thereof, said upper part being shaped to receive a foot of a wearer, said plurality of openings providing communication between an exterior of the upper part and an interior of the upper part and comprising two-way air flow openings extending between the interior and the exterior of the upper part and allowing a flow of air both in and out of the article of footwear;

a waterproof, breathable membrane attached to said upper part across the plurality of openings;

there being no dust or mud protector on the article of footwear outwardly of the upper part adjacent the air flow openings; and a compressible insole having an upper surface providing a foot bed for the foot of the wearer, and a bottom surface having a plurality of outwardly open channels formed therein in communication with the plurality of openings in the arch portion of the upper part, said plurality of channels serving to guide the flow of air both in and out of the article of footwear via the air flow openings and the membrane.

2. The article of footwear according to claim 1, wherein said compressible insole further comprises a plurality of substantially vertical through openings in register and communication with said plurality of channels.

3. The article of footwear according to claim 1, wherein said compressible insole further comprises a textile lining disposed on an upper side of said insole.

4. The article of footwear according to claim 1, wherein said arch portion is located on a medial side of said upper part, and said compressible insole further comprises an upwardly extending portion in said arch portion.

5. The article of footwear according to claim 4, wherein said upwardly extending portion has a plurality of channels in communication with one or more of said plurality of channels on the bottom surface of said compressible insole.

6. The article of footwear according to claim 5, wherein said plurality of channels in said upwardly extending portion in the arch portion located on said medial side are in register and communication with said plurality of openings in said upper part.

7. The article of footwear of claim 5, wherein said plurality of channels in said upwardly extending portion in the arch portion of said compressible insole located on said medial side terminate in a cavity in said compressible insole that is in communication with said plurality of openings in said upper part.

8. The article of footwear of claim 1, further comprising:

a lower part incorporating a sole.

9. The article of footwear of claim 1, wherein said membrane is a size approximating an area covering a surface area of said plurality of openings.

10. The article of footwear of claim 1, wherein said membrane is a size having dimensions approximating an area larger than a surface area covering said plurality of openings.

11. The article of footwear of claim 1, wherein each of said plurality of openings has a diameter approximating a few millimeters.

* * * * *